United States Patent [19]

Goldsberry

[11] 3,932,159

[45] Jan. 13, 1976

[54] REFRIGERANT EXPANDER COMPRESSOR

[75] Inventor: Fred L. Goldsberry, Amarillo, Tex.

[73] Assignee: Enserch Corporation, Dallas, Tex.

[22] Filed: Sept. 20, 1974

[21] Appl. No.: 507,863

Related U.S. Application Data

[62] Division of Ser. No. 422,759, Dec. 7, 1973, Pat. No. 3,864,065.

[52] U.S. Cl. ..... 62/510; 62/115; 62/87; 62/498; 62/402

[51] Int. Cl.[2] ..... F25B 1/10

[58] Field of Search ..... 62/115, 116, 498, 87, 402, 62/467, 510

[56] References Cited

UNITED STATES PATENTS

| | | | |
|---|---|---|---|
| 1,938,205 | 12/1933 | Yeomans | 62/116 |
| 2,394,109 | 2/1946 | Sanchez | 62/402 |
| 2,494,120 | 1/1950 | Ferro | 62/87 |
| 2,519,010 | 8/1950 | Zearfoss | 62/116 |
| 2,737,031 | 3/1956 | Wulle | 62/498 |
| 3,277,658 | 10/1966 | Leonard | 62/116 |

*Primary Examiner*—William J. Wye
*Attorney, Agent, or Firm*—Richards, Harris and Medlock

[57] ABSTRACT

An expander compressor unit for a vapor compression refrigeration system is disclosed. The unit has a rotor which is provided with radial passageways terminating in tangentially oriented nozzles for expanding the high-pressure fluid and utilizing the kinetic energy of the expanding fluid to propel the rotor. The rotor is in driving engagement with a compressor which serves to compress fluid in the cycle. By this means the expander compressor unit substantially improves the efficiency of the cycle through efficient expansion of the refrigerant prior to evaporization and through reduction of the net work input into the system.

2 Claims, 6 Drawing Figures

REFRIGERANT EXPANDER COMPRESSOR

This is a division of application Ser. No. 422,759, filed Dec. 7, 1973, now U.S. Pat. No. 3,864,065.

BACKGROUND AND SUMMARY OF THE INVENTION

The present invention relates generally to refrigeration systems, and more particularly, to an expander compressor unit which utilizes the work expended in direct expansion of a refrigerant to power a turbine which drives a small compressor to aid the primary compressor of a refrigeration system in compressing gaseous vapors from evaporator pressure to condenser pressure.

Vapor compression refrigeration cycles and apparatus for carrying out these cycles are well known. In theoretical vapor compression refrigeration, saturated vapor refrigerants at low pressure enter a compressor and undergo isentropic compression. The high pressure vapor enters a condenser and heat is rejected from the fluid at constant pressure from the condenser. The working fluid leaves the condenser as a saturated liquid. An isenthalpic throttling process follows across an expansion valve or capillary tube. The working fluid is then evaporated at constant pressure with the working fluid absorbing heat to complete the cycle.

In the past, the design of direct expansion refrigeration units has not generally taken advantage of the energy or available work lost in the execution of the cycle through the throttling or free expansion of the liquid refrigerant into the evaporator of the refrigeration machine. Generally, only limited use has been made of the conversion into mechanical energy of the kinetic energy possessed by the refrigerant which flows from the high pressure side to the low pressure side of the refrigeration system. For example, it is known to power a compressor with the refrigerant discharged from the capillary tube. The compressor is arranged in the auxiliary circuit which includes a second evaporator. In this way, a two temperature system is provided in which the additional evaporator can be operated within a temperature range lower than that of the evaporator in the main circuit. Typical of systems of this type is the refrigeration system method shown in U.S. Pat. No. 2,519,010.

Other attempts at utilizing the kinetic energy of refrigerant expansion have concentrated mainly on pumping or recirculating refrigerant or lubricants. For example, U.S. Pat. No. 2,763,995 discloses the use of high pressure refrigerant directed against the blades of a turbine. The turbine has a shaft which is connected to a centrifugal pump. The pump serves to recirculate oil rich liquid refrigerant back to the compressor.

Generally, however, systems as described above which utilize or attempt to utilize the work expanded in the throttling or expansion process have not found wide acceptance. As pointed out, most of these systems attempt to utilize the kinetic energy to perform some auxiliary operation such as the circulation of lubricating fluid. Accordingly, the equipment necessary for its recovery has not been thought to be economically feasible. Very little work has been done in utilizing this energy to improve the performance and efficiency of the basic vapor compression refrigeration cycle.

The present invention provides an expander compressor in which the saturated liquid from the condenser is expanded and flashed through nozzles of a shaft mounted rotor causing a tangential propelling force to be applied to the rotor and an attached turbine shaft. The turbine shaft drives an axial compressor unit. On the compressor side, saturated vapor from the evaporator enters the vane chamber of the compressor and is compressed into the super heat region and is discharged into an annular chamber either to the primary compressor or directly to the condenser of the air conditioning unit. A small fraction of the saturated liquid refrigerant entering the unit is utilized to provide full film lubrication of the shaft bearings. The compressor section of the unit may include an appropriate inducer section to pull the refrigerant into the blades of the compressor section. The rotor can be modified for various capacity systems by changing the nozzle size or by adding more discharge passages to the expander section.

DESCRIPTION OF THE DRAWINGS

The above and other objects and advantages of the present invention will become apparent from reading the following claims, specifications and drawings in which:

DETAILED DESCRIPTION

Figure 1:
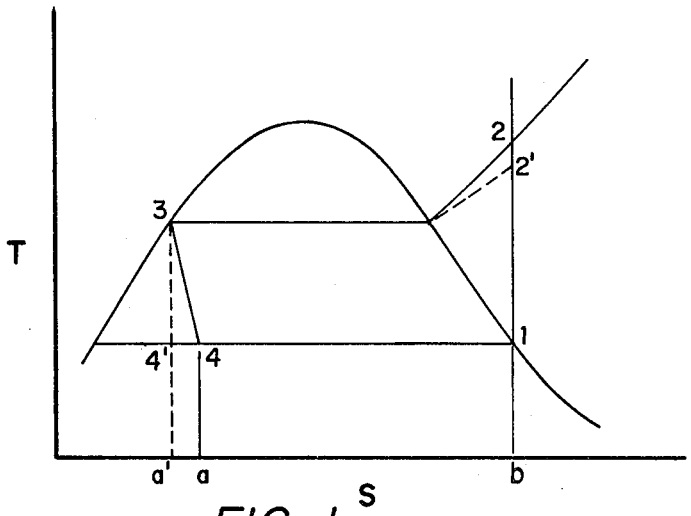
FIG. 1 is a graphical representation of a vapor compression refrigeration cycle on the temperature (T) and entropy (S) coordinates.

The theoretical ideal cycle for vapor compression refrigeration is shown in FIG. 1 and represented as cycle 1,2,3,4,1. The cycle of operation is shown on the T-S plane. Point 1 represents the state of the refrigerant entering the compressor. Usually in this state the refrigerant is nearly dry saturated vapor. The saturated vapor at low pressure enters the compressor and undergoes adiabatic compression 1–2. During the compression, the refrigerant is usually super-heated. In state 2, the super-heated vapor passes into the condenser and is cooled at constant pressure and then condensed at constant temperature. Heat is rejected in the process 2 to 3. The working fluid leaves the condenser as a saturated liquid. A throttling process follows from 3–4 and the working fluid is then evaporated in process 4 to 1, to complete the cycle. During the evaporation process, the refrigerant is vaporized. As is well known in thermodynamics, the amount of heat (QL) removed by the refrigerant is represented by the change in entropy occurring in the process 4 to 1 as projected on the horizontal coordinate as *a–b*. The work (W) expended in achieving this amount of heat removal represented along *a–b* is represented by the energy expended in compression from 1 to 2 as seen in FIG. 1. The coefficient of performance (COP) of a refrigeration cycle is represented by the equation:

$$COP = \frac{Q_L}{W}$$

The present invention utilizes conversion of the kinetic energy of the refrigerant to mechanical energy to drive a turbine in the system located between the condenser and the evaporator. The high pressure refrigerant is expanded through nozzles located on a turbine rotor. The turbine is mechanically connected to drive a centrifugal compressor located downstream of the evaporator which serves to partially compress the refrigerant prior to entry at the intake of the main compressor. The schematic representation of the system of the present invention is shown in FIG. 2.

Figure 2:
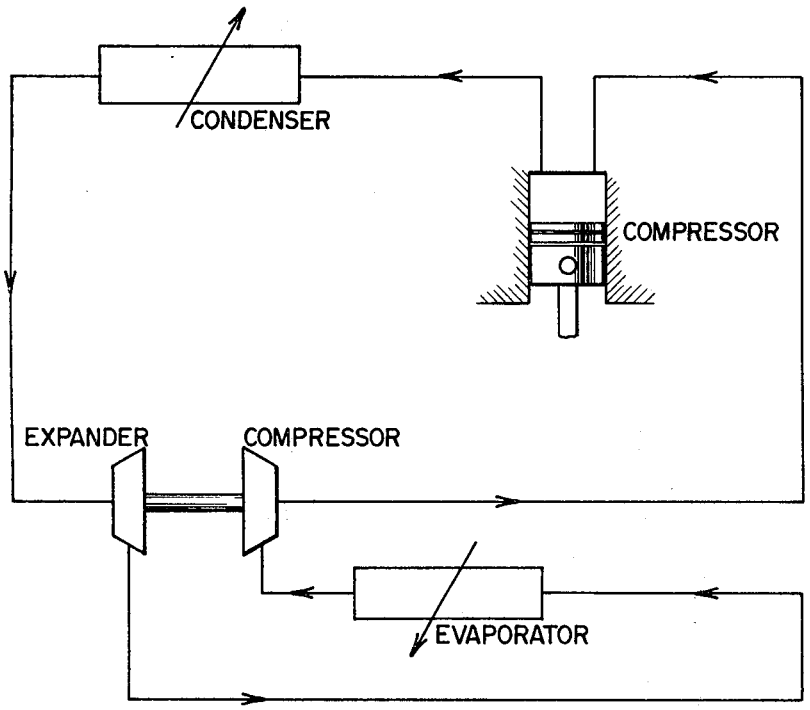
FIG. 2 is a schematic representation of the vapor compression refrigeration cycle.

As can be seen in FIGS. 1 and 2 a small expander-compressor can boost the performance of the refrigeration cycle by two mechanisms. A discussion of the theoretical advantages derived from the present invention will assist in understanding the present invention. The first mechanism by which efficiency is improved is removal of energy from the saturated liquid vapor mixture during throttling prior entry to the evaporator to improve the heat absorbing capability of the mixture. As the vapor mixture reaches the evaporator at lower entropy, the vapor is able to absorb an additional amount of heat equal to the work dissipated by the fluid in reaching the evaporator to the expander turbine. Referring to FIG. 1, isentropic expansion through the nozzle is shown by the dotted line 3–4′. Thus the amount of heat which can be absorbed by the refrigerant in the evaporator is increased by the amount represented between $a'$–$a$ on the entropy coordinate.

The second mechanism by which the overall efficiency or coefficient of performance of the refrigeration cycle is improved is through the reduction of the amount of external work brought in the system during compression of the refrigerant between 1 and 2′. Thus by compressing or partially compressing the gas exiting from the evaporator, the suction pressure on the compressor is increased and the amount of work brought externally into the system is reduced.

Figure 3:
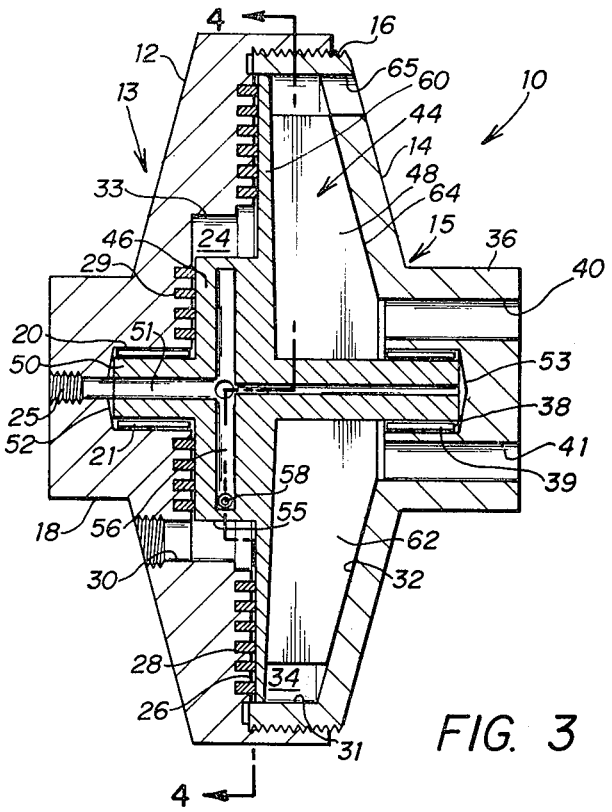
FIG. 3 is a longitudinal sectional view showing the expander compressor of the present invention.
Figure 4:
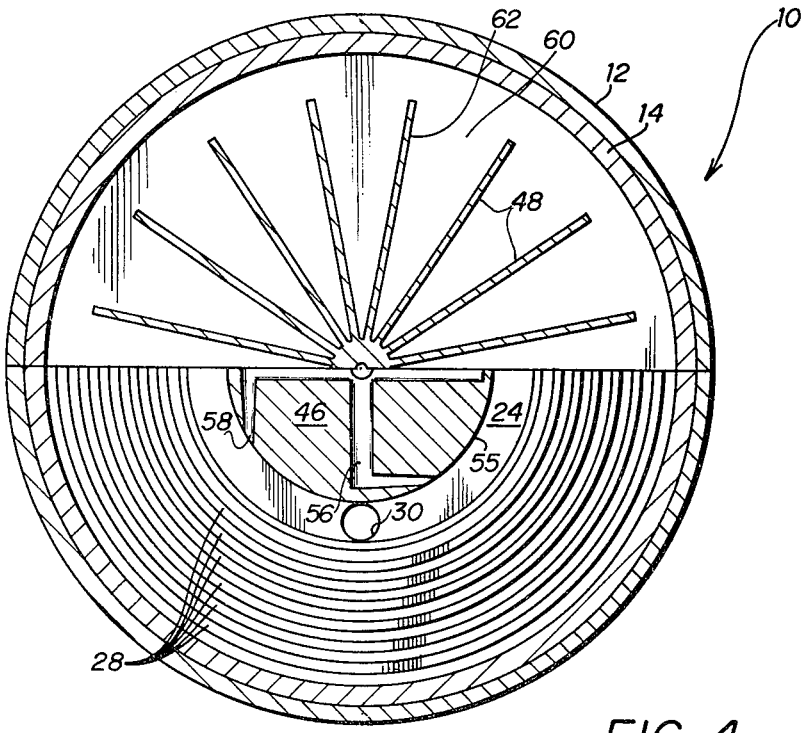
FIG. 4 is a sectional view taken along lines 4—4 of FIG. 3.

FIGS. 3 and 4 show in detail the expander compressor of the present invention. The machine of the present invention is generally designated by the numeral 10. The unit has cooperating housing members 12 and 14 which respectively define the expander section 13 and compressor section 15 of the machine. Housing sections 12 and 14 may be integrally joined or may be cooperatively fitted together at annular threaded section 16. Housing section 12 is formed with a projecting boss 18. Boss 18 is bored at 20 for reception of precision shaft bearings 21 which are pressed into the bore. Circular expansion chamber wall 33 is generally concentric with bore 20. The radial face 26 of housing portion 12 is provided with a concentric series of labyrinth seals 28 formed in the surface. Outlet port 30 communicates with expansion chamber 24 near the periphery of the chamber.

Compressor chamber 34 is formed in housing member 14 by peripheral surface 31 and generally convex surface 32. Boss 36 axially projects from housing member 14 and is counterbored at 38 for reception of precision shaft bearings 39. Axial inlet passageways 40 and 41 communicate with compressor chamber 34 through boss 36.

The turbine unit is generally designated by the numeral 44 and includes an expander rotor 46 and a compressor section 48. Turbine unit 44 is mounted on axial shaft 50 which has its opposite ends mounted for rotation in bearings 21 and 39 in the expansion and compression sections of the unit. Turbine 44 is preferably of steel or a high quality precision molded or machined synthetic such as nylon. An axial passageway 51 extends through shaft 50 communicating at the expander side with inlet 25 in boss 18. Inlet 25 is internally threaded to accommodate a refrigerant line fitting. Small radial clearance passageways 52 and 53 are provided in the bearing bores at the opposite end of shaft 50 to permit fluid within axial passageway 51 to be admitted to bearings 21 and 39 for lubrication.

Rotor 46 of turbine 44 has a generally circular peripheral edge 55 which, with housing wall 33, defines the annular expansion chamber 24. A plurality of radial passages 56 extend in rotor 46 and communicate with axial passageway 51. As best seen in FIG. 4, the ends of radially opposite passageways 56 terminate in oppositely directed tangential nozzles 58. The number and location of the passageways 56 and associated nozzles 58 will vary with the capacity of the refrigeration unit. It is to be understood that evenly spaced, oppositely disposed passageways and nozzles are required so that expanding fluid exerts a balanced tangential force to propel the turbine rotor. Expansion chamber 24 is sealed by labyrinth seals 28 and 29 provided on the parallel radial surfaces of housing section 12.

The compressor side of turbine 44 includes a generally circular impeller plate 60 which has one surface in sealing engagement with labyrinth seals 28. A plurality of compressor vanes 62 are radially positioned on the opposite side of impeller plate 60. As seen in FIG. 3, the vanes are formed having outer converging edge 64 which closely cooperates with interior housing surface 32. The outer tip of the compressor vanes 62 and housing wall 31 define annular compressor chamber 34. Outlet 65 communicates with chamber 34 and is adapted to be connected in the refrigeration system.

With the expander compressor unit connected in a refrigeration system as shown schematically in FIG. 2, the operation of the unit will be as follows. A saturated liquid refrigerant is supplied to the expander compressor unit 10 at inlet 25. The liquid refrigerant flows into axial passageway 51 and is admitted along radial passageways 52 and 53 to lubricate bearings 21 and 39 at the opposite ends of shaft 50. The high pressure saturated liquid refrigerant also flows through radial passageways 56 in the rotor and expands and flashes through nozzle openings 58 at the ends of passageways 56. The expansion through nozzles 58 imparts a tangential force propelling turbine 44. The rotor and nozzle arrangement is a particularly efficient expansion device. The expansion through the nozzle is substantially isentropic. The energy normally lost by expansion through a valve or capillary is conserved in the instant case with the resulting two phase mixture having lesser velocity than a mixture having been expanded through an expansion valve. The discharge from the nozzle enters the annular exhaust chamber 24 at a lower quality than if the mixture had been expanded through a fixed nozzle. The mixture is discharged from chamber 24 at passage 30 where it enters the evaporator.

On the compressor side 15 of the unit, saturated vapor returning from the evaporator enters the compressor at passages 40 and 41. The rotating vanes 62 compress the entering vapor into the superheat region and the vapor is admitted into annular compressor chamber 34 and is discharged at passageway 65. From discharge passageway 65 the pressurized vapor flows either to the primary compressor or directly to the condenser of the apparatus.

Figure 5:
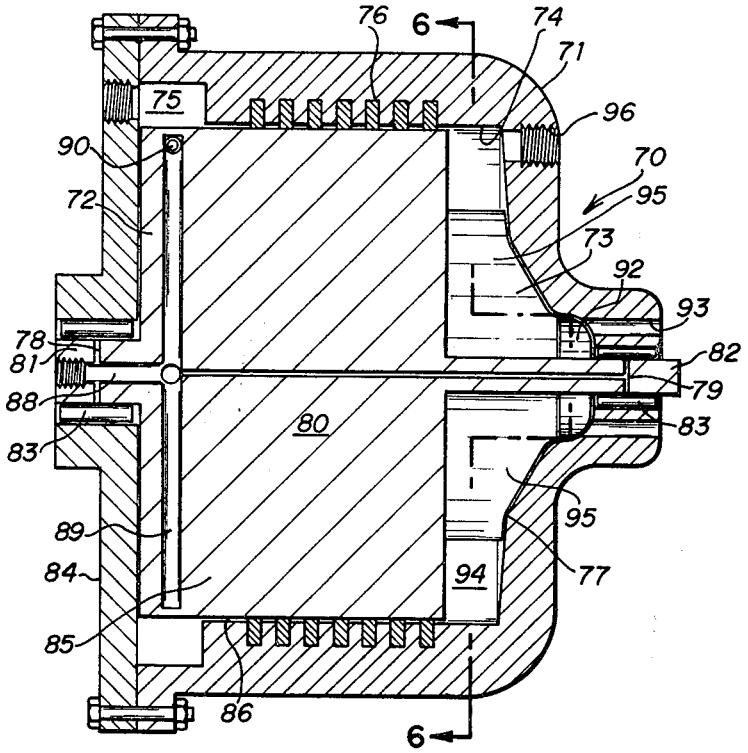
FIG. 5 is a longitudinal sectional view showing another embodiment of the expander compressor of the present invention.
Figure 6:
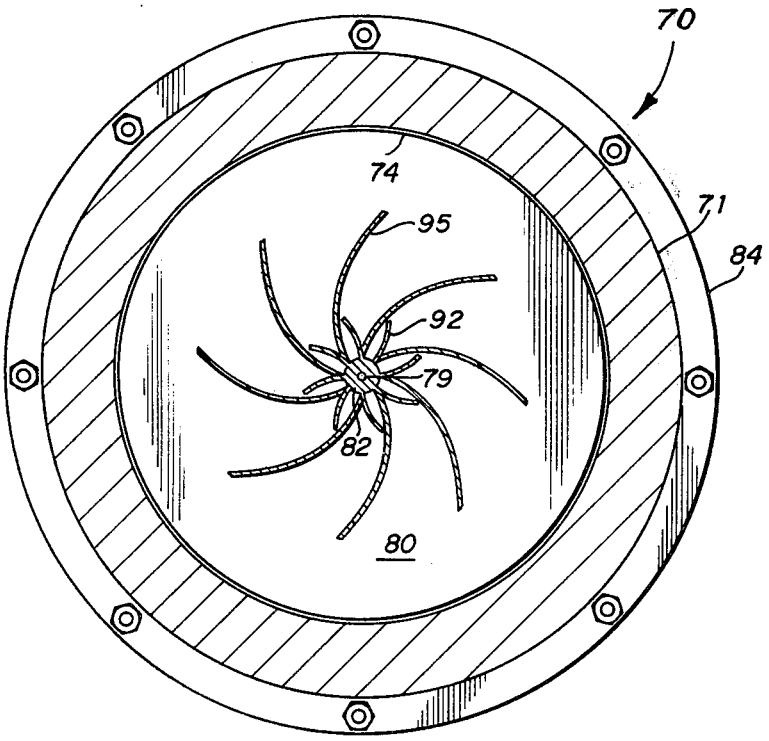
FIG. 6 is a sectional view taken along lines 6—6 of FIG. 5.

Another embodiment of the present invention is shown in FIGS. 5 and 6 and is generally designated by the numeral 70. The unit of embodiment 70 includes a housing 71 enclosing expander section 72 at one end and a compressor section 73 at the other end. The interior of housing 71 has a generally cylindrical bore 74 enclosed by end plate 84. A series of annular labyrinth seals 76 are peripherally arranged in bore 74. An annular expander chamber 75 is provided in the housing wall.

In the compressor end of the unit, the interior of chamber bore 74 has a radially outwardly converging end wall 77 which defines compressor chamber 94.

A turbine member 80 is rotatively mounted within housing 71 at opposite stub shafts 81 and 82 supported in appropriate non-friction bearings 83. The turbine rotor 85 has cylindrical outer surface 86 in close relationship with bore 74. An axial passage 88 in stub shaft 81 communicates with radially extending passages 89. Bleed passageways 78 and 79 provide for positive lubrication of bearings 83 with liquid refrigerant. The end of radial passages 89 communicate with chamber 75 across nozzles 90 propelling turbine 80 with a tangential force. Nozzles 90 preferably are in threaded engagement at the end of passage 89 to facilitate replacement with various other size nozzles to change the capacity of the unit.

Forwardly curved inducer blades 92 are located in compressor section 73 immediately adjacent the inlet 93 to the compressor section. Inducer blades 92 serve to induce or pull the saturated vapor into the compressor section. Compression takes place by means of the rotating reversed-curved compressor blades 95 which impart energy to the fluid as it flows along the impeller blades. Discharge from compression chamber 94 is at outlet 96.

In operation, the expander compressor of the present embodiment is similar to that described above with reference to the previous embodiment. Saturated liquid is supplied at inlet passage 81 to the unit. The saturated liquid expands and flashes through nozzles 90 causing a tangential force propelling the turbine 80. The flashed vapor liquid is discharged into annular chamber 75 and from there it enters the evaporator. A small fraction of the saturated liquid refrigerant may be diverted to the bearing annulus area through bleed passageways 78 and 79 to provide for full film lubrication of the rotor bearings. On the compressor side, saturated vapor from the evaporator enters inlet 93 assisted by the inducer blades 92. The saturated vapor is compressed into the superheat region by compressor vanes 95 and discharged into the compressor chamber and finally through discharge passageway 96 to either the compressor or directly to the condenser in the air conditioning unit. The high and low pressure side of the unit are separated by peripheral labyrinth seals 76.

It will be noted that in embodiment 70 of FIG. 5, the rotor section of the turbine is of greater diameter than the turbine compressor blades. Several considerations must be taken into account to insure that the expander can operate efficiently as an isentropic expander. For effecient operation there is also need for torque matching between the expander and the compressor.

The present compressor expander provides a unit which can substantially increase the efficiency of a vapor compression refrigeration cycle. As explained, a small expander boosts performance in cooling machines by two mechanisms: (1) removal of energy from the saturated liquid vapor mixture as it enters the evaporator to improve the heat absorbent capability of the mixture. (2) reduction of the amount of work required externally to the system. Thus, with the present invention the equation for coefficient of performances becomes $$COP = \frac{Q+dQ}{\text{work}-dW}.$$

Note that with the present invention that should the turbine fail to function, there is no appreciable loss to the system. However, any work transferred through the turbine centrifugal compressor adds considerably to the performance of the cycle.

An example of the increased efficiency theoretically obtainable with the present invention has been worked out for a simple refrigeration cycle working between 140° F and 40° F, assuming reasonable efficiencies for all mechanical components:

FROM THE PROPERTIES TABLE FOR F-12

| | Btu/lbm | Btu/lbm.°R |
|---|---|---|
| Sat Liq. | | $S_f = .08024$ |
| 140°F | $hf = 41.24$ | $S_{fg} = .08339$ |
| 220 psia | | $S_g = .16363$ |
| | $h_f = 17$ | $S_f = .03690$ |
| 40°F | $h_{fg} = 65.71$ | $S_{fg} = .13153$ |
| | $h_g = 82.71$ | $S_g = .16833$ |

$S_{140} = .08024 = S_{f_{40}} + q\, S_{fg_{40}} = .03680 + q\,(.13153)$ $q = .33026$ $h_{40} = h_f + q\, h_{fg} = 17.0 + .33026\,(65.71) = 38.701$ $h_{f_{140}} - h_{40} = 41.24 - 38.70 = 2.5 \ \frac{BTU}{lbm}$ isentropic work input to cycle $= 11 \ \frac{BTU}{lbm}$ adiabatic expansion heat removal $= 41.5 \ \frac{BTU}{lbm}$ $$COP = \frac{41.5}{11/.9} = 3.681\,(.9) = 3.3954$$

$$COP_{sc} = \frac{\text{Heat Removed} + \text{Isentropic Work* Expansion Eff}}{\dfrac{\text{Work Read.} - \text{Isentropic Work * Exp. Eff. * Comp. Eff.}}{\text{Comp. Eff.}}}$$

$$COP_{sc} = \frac{41.5 + 2.5 * .70}{\dfrac{11 - 2.5 * .70 * .70}{.9}} = \frac{43.25}{10.997} = 3.932$$

$COP = 3.3954$ $COP_{super\ charged} = 3.932$

% Increase = 15.72%

Thus from the foregoing, it will be seen that the present invention provides an expander compressor adaptable for use with conventional vapor compression refrigeration cycles. The unit is simple having an integral single piece expander and centrifugal compressor rotor without an intermediate bearing support. The expander turbine uses the flashed and saturated liquid propulsion energy that is generally not utilized in conventional systems. The use of the liquid refrigerant for simple full pressure general bearing lubrication adds to the efficiency of the unit.

It will be obvious to those skilled in the art to make changes and modifications to the device of the present invention. To the extent that these changes, alterations and modifications do not depart from the spirit and scope of the present invention, they are intended to be encompassed herein.

What is claimed is:

1. A refrigeration system comprising:

a condenser adapted to receive high pressure refrigerant;

an expander unit including a housing with an axially extending shaft mounted for rotation therein, said shaft having a fluid inlet passageway formed therein communicating with the discharge from said condenser and a rotary impeller mounted on said shaft for rotation therewith, said impeller including a passageway communicating between said inlet passageway and nozzle means adapted to effect refrigerant discharge at a distance from said inlet passageway and perpendicular to a radial line between said inlet passageway and said nozzle means to impart rotation to said impeller by reaction to the refrigerant discharge from said nozzle means;

an evaporator communicating with the low pressure discharge from said expander; and a compressor connected to the outlet of said evaporator, said compressor including a rotary member in driven engagement with said impeller whereby the energy of expansion is partially recovered in the cycle.

2. The system of claim 1 including a primary compressor receiving the discharge from said compressor and wherein said compressor serves as a secondary compressor to effectively reduce the net work introduced into the system.

* * * * *